US009403270B2

(12) United States Patent
Lin

(10) Patent No.: US 9,403,270 B2
(45) Date of Patent: Aug. 2, 2016

(54) TOOL BOX WITH A POSITIONING DEVICE

(71) Applicant: Chia-Szu Lin, Taichung (TW)

(72) Inventor: Chia-Szu Lin, Taichung (TW)

( * ) Notice: Subject to any disclaimer, the term of this patent is extended or adjusted under 35 U.S.C. 154(b) by 130 days.

(21) Appl. No.: 14/499,220

(22) Filed: Sep. 28, 2014

(65) Prior Publication Data

US 2016/0089773 A1 Mar. 31, 2016

(51) Int. Cl.
*B25H 3/02* (2006.01)
*B65D 25/10* (2006.01)

(52) U.S. Cl.
CPC ..... *B25H 3/02* (2013.01); *B25H 3/022* (2013.01); *B65D 25/10* (2013.01); *B65D 25/106* (2013.01); *B65D 25/107* (2013.01)

(58) Field of Classification Search
CPC ..... B25H 3/00; B25H 3/003; B25H 3/006; B25H 3/02; B25H 3/021; B25H 3/023; B25H 3/022; B25H 3/025; B25H 3/026; B25H 3/04; B25H 3/06; B25B 13/56; A61C 3/04; A47F 7/0028; B65D 7/065; B65D 25/04; B65D 25/02; B65D 25/10; B65D 25/101; B65D 25/103; B65D 25/105; B65D 25/106; B65D 25/107
See application file for complete search history.

(56) References Cited

U.S. PATENT DOCUMENTS 2,754,974 A * 7/1956 Larson ..... A47L 13/512 108/152
6,145,662 A * 11/2000 Newton ..... B25H 3/06 206/373

* cited by examiner

*Primary Examiner* — Anthony Stashick
*Assistant Examiner* — Mollie Llewellyn
(74) *Attorney, Agent, or Firm* — Pai Patent & Trademark Law Firm; Chao-Chang David Pai

(57) ABSTRACT

A tool box has two bodies, two inner boxes, a positioning device, a positioning block, and a buckle unit. The inner boxes are respectively mounted in the bodies. Each positioning device has a fixing base mounted in one of the inner boxes and a fixing elastic plate. The fixing base has two hooking portions and two recesses respectively formed in two ends of the hooking portions. The fixing elastic plate is detachably mounted on the fixing base and has an inserting portion and two hooking portions respectively engaged with the recesses. The positioning block is mounted on the inserting portion and has multiple tool recesses. The buckle unit is mounted on the bodies.

6 Claims, 6 Drawing Sheets

TOOL BOX WITH A POSITIONING DEVICE

BACKGROUND OF THE INVENTION

1. Field of the Invention

The present invention relates to a tool box, and more particularly to a tool box with a positioning device.

2. Description of Related Art

A conventional tool box has a tool positioning block mounted in the tool box. The tool positioning block is made of foam material and has multiple positioning recesses. The positioning recesses are formed in the tool positioning block at intervals. In use, multiple tool heads are respectively placed in the positioning recesses.

However, the tool positioning block is often securely mounted in the tool box with adhesive. When the tool positioning block needs to be replaced with a different one, the replacing process is difficult for a user.

SUMMARY OF THE INVENTION

The main objective of the present invention is to provide a tool box with a positioning device to resolve the afore-mentioned problems.

The tool box has two bodies, two inner boxes, at least one positioning device, at least one positioning block, and a buckle unit.

The bodies are connected with each other. Each body has a side wall being annular and a body space formed in the body and having an opening located at a side of the body.

The inner boxes are respectively mounted in the body spaces.

The at least one positioning device is mounted on a side of one of the inner boxes, and each positioning device has a fixing base and a fixing elastic plate. The fixing base is combined on the side of said one of the inner boxes and has a combining portion combined with the inner box, two hooking portions respectively connected with two ends of the combining portion and being opposite to each other, and two recesses respectively formed in two ends of the hooking portions. The fixing elastic plate is detachably mounted on the fixing base and has an inserting portion being curved and two hooking portions being hooked, respectively connected with two ends of the inserting portion, and respectively engaged with the recesses.

The at least one positioning block is mounted on the at least one positioning device, and each positioning block has at least one fixing recess and multiple tool recesses. The at least one fixing recess is formed in a side of the at least one positioning block and engaged with the inserting portion of the at least one positioning device. The tool recesses are formed in a side of the positioning block at a position opposite to the at least one fixing recess.

The buckle unit is mounted on the bodies.

Other objectives, advantages and novel features of the present invention will become more apparent from the following detailed description when taken in conjunction with the accompanying drawings.

DETAILED DESCRIPTION OF PREFERRED EMBODIMENT

Figure 1:
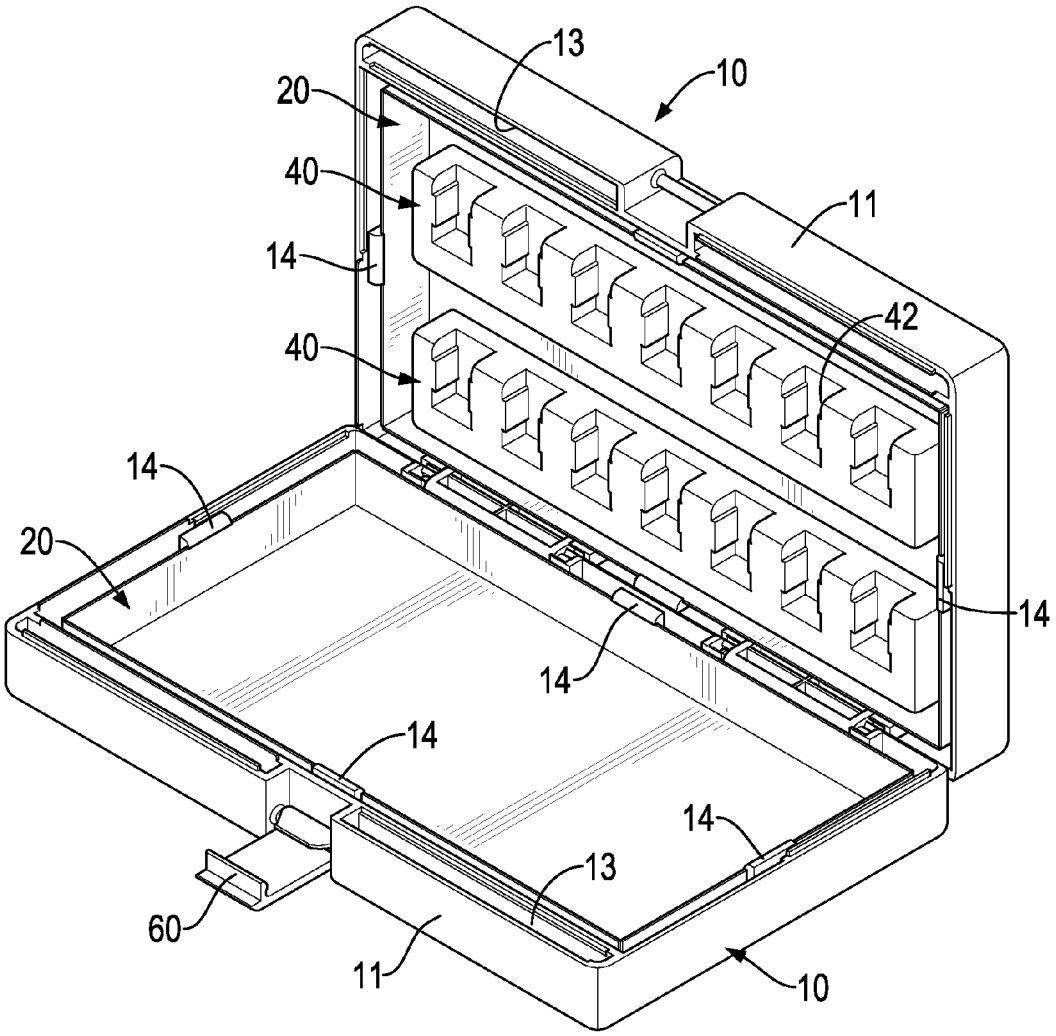
FIG. 1 is a perspective view of a first preferred embodiment of a tool box in accordance with the present invention.

With reference to FIGS. 1 to 4, a first preferred embodiment of a tool box in accordance with the present invention has two bodies 10, two inner boxes 20, four positioning devices 30, two positioning blocks 40, a connecting unit 50, and a buckle unit 60.

Figure 2:
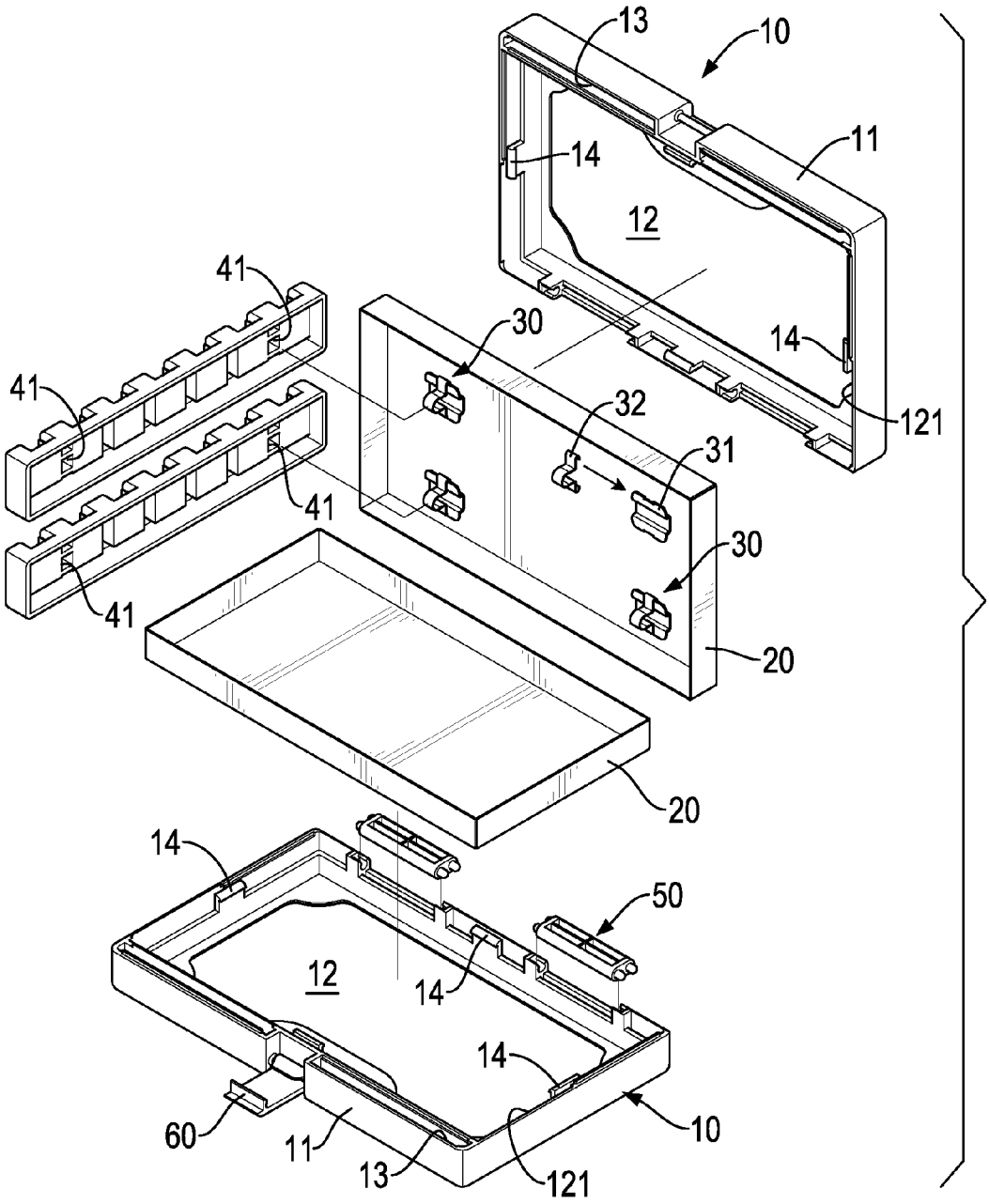
FIG. 2 is an exploded perspective view of the tool box in FIG. 1.

With reference to FIGS. 1 and 2, the structures of the bodies 10 may be same with each other. Each body 10 has a side wall 11, a body space 12, a collision-resistant space 13 and two engaging portions 14. The side wall 11 is annular. The body space 12 is formed in the body 10 and has an opening 121 located at a side of the body 10. The collision-resistant space 13 is formed in a part of the side wall 11, such that the part of the side wall 11 provided with the collision-resistant space 13 is hollow. The body spaces 12 of the bodies 10 selectively communicate with each other. The engaging portions 14 are formed on an inner side of the body 10. The inner boxes 20 are respectively mounted in the bodies 10 and are detachably engaged with the engaging portions 14.

Figure 3:
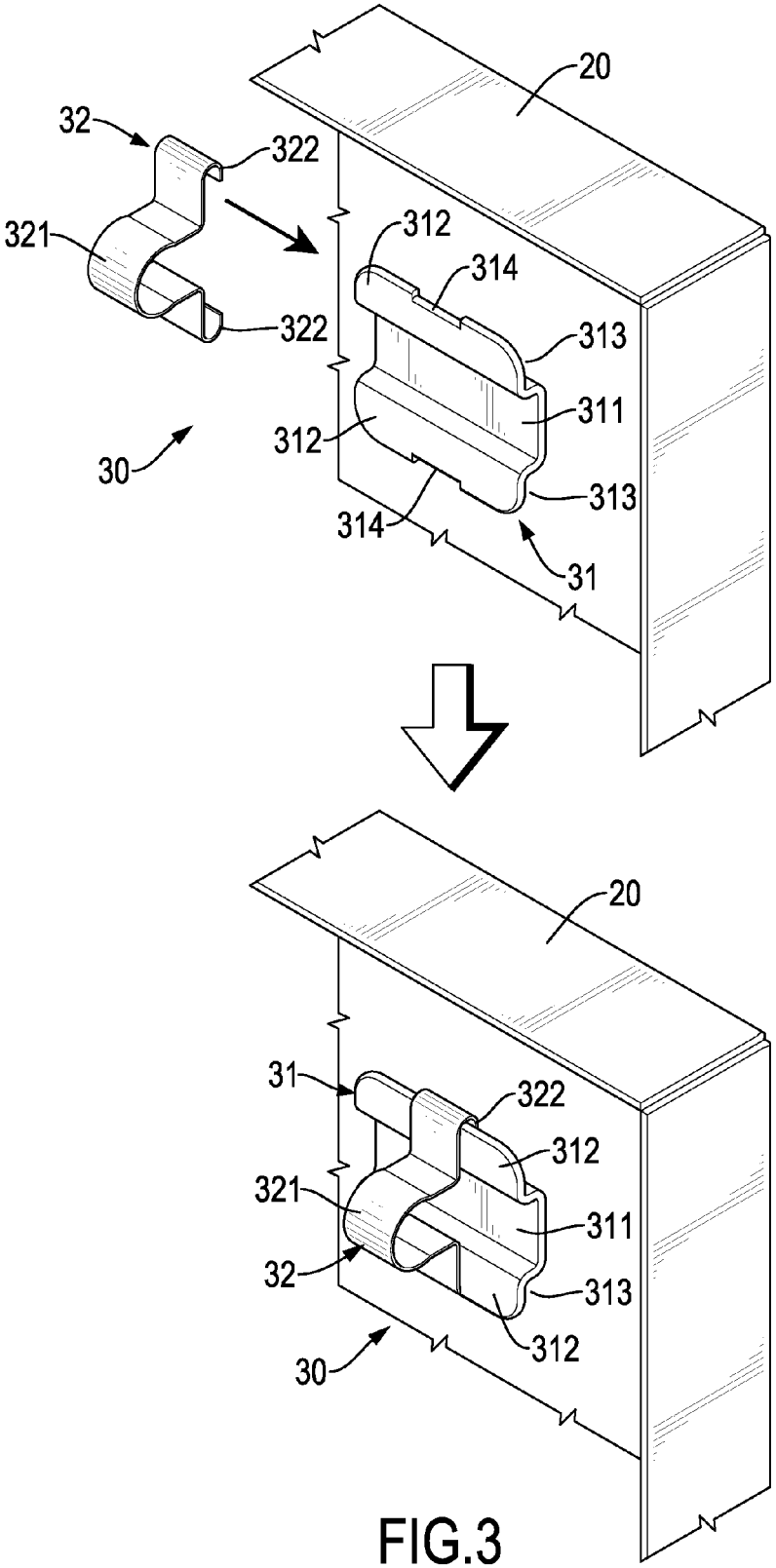
FIG. 3 shows enlarged operational perspective views of the tool box in FIG. 1.
Figure 4:
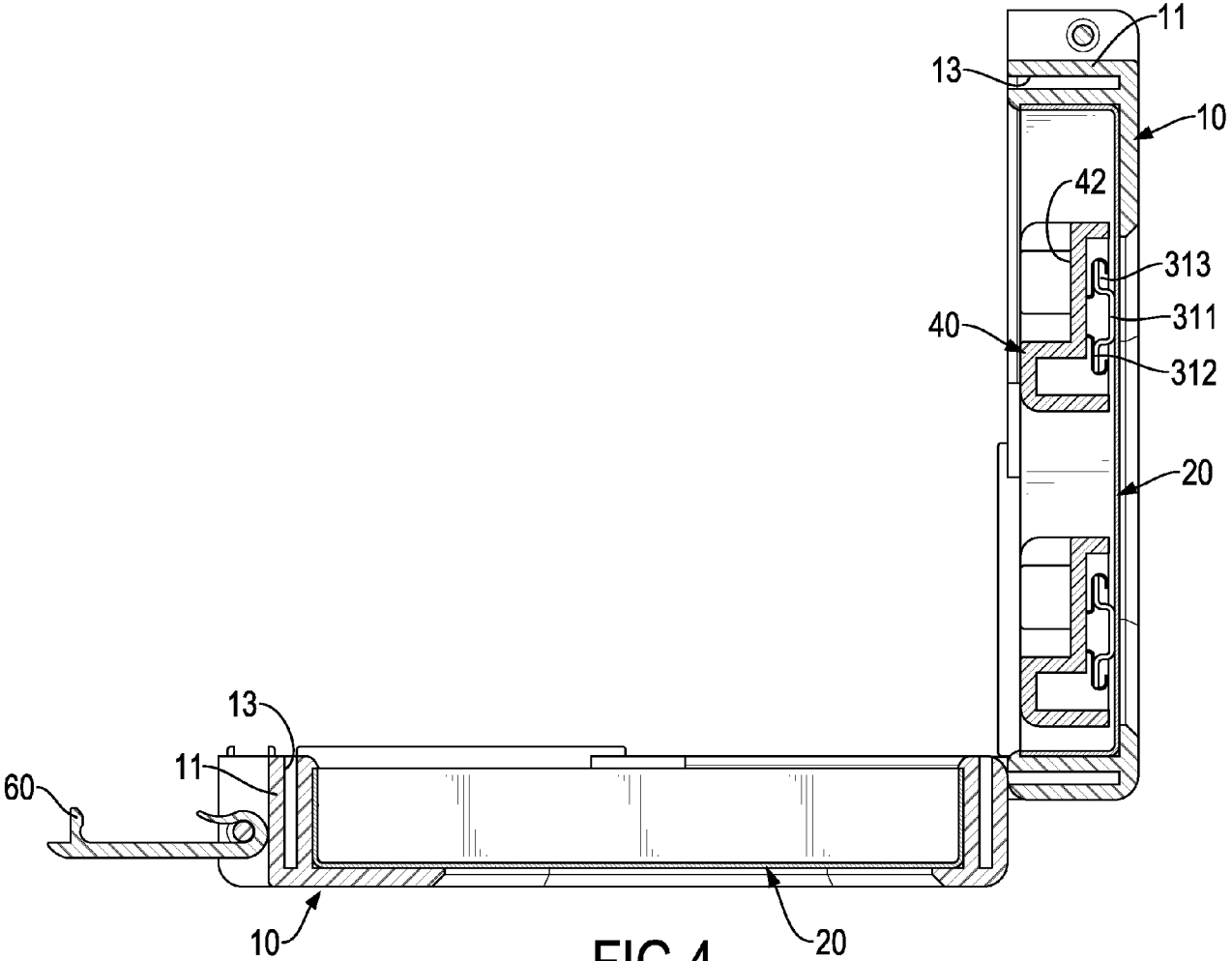
FIG. 4 is a cross sectional side view of the tool box in FIG. 1.
Figure 5:
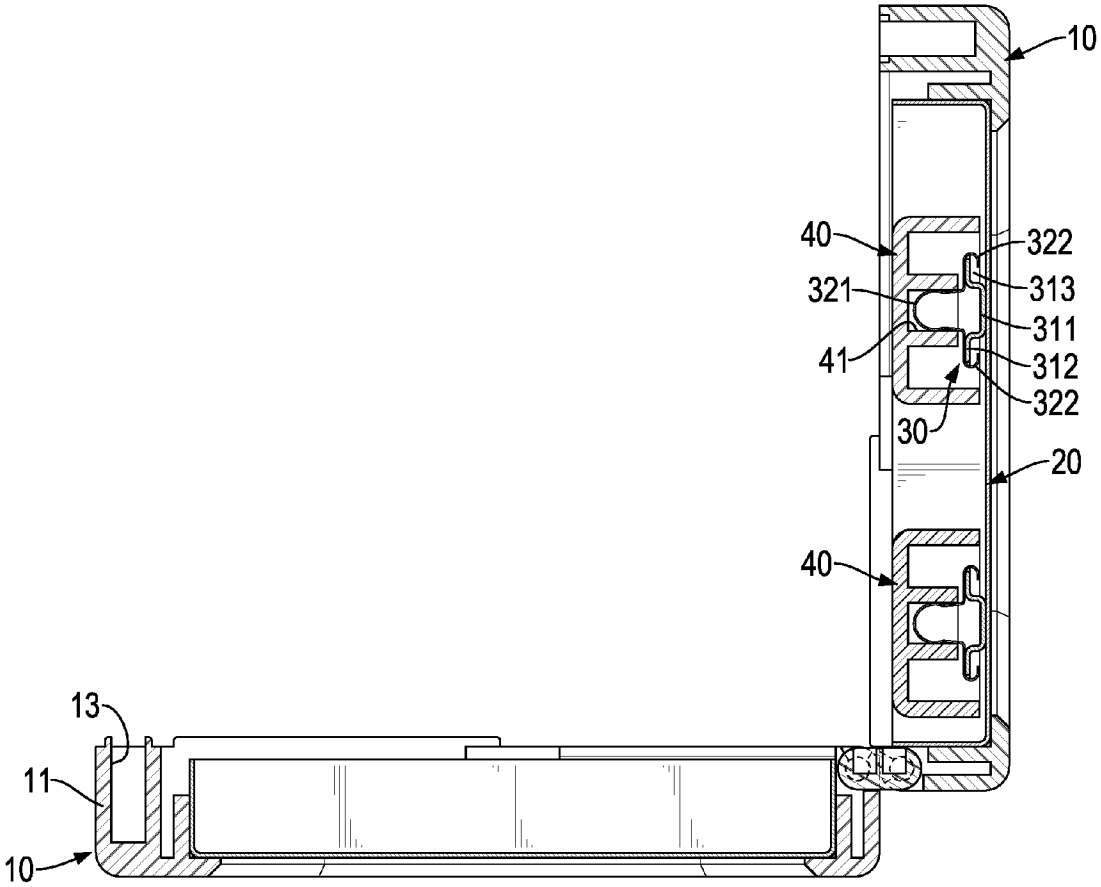
FIG. 5 is another cross sectional side of the tool box in FIG. 1.

With reference to FIGS. 3 to 5, the positioning devices 30 are mounted on a side of one of the inner boxes 20. Each positioning device 30 has a fixing base 31 and a fixing elastic plate 32. The fixing base 31 is mounted on the side of said one of the inner boxes 20 and has a combining portion 311, two hooking portions 312, two hook spaces 313 and two recesses 314. The combining portion 311 is combined with the inner box 20. The hooking portions 312 are bent, are respectively connected with two ends of the combining portion 311, and are opposite to each other. The hook spaces 313 are respectively formed between the hooking portions 312 and the inner box 20 since the hooking portions 312 are bent. The recesses 314 are respectively formed in two ends of the hooking portions 312. The fixing elastic plate 32 is detachably mounted on the fixing base 31 and has an inserting portion 321 and two hooking portions 322. The inserting portion 321 is curved. The hooking portions 322 are hooked, are respectively connected with two ends of the inserting portion 321, and are respectively engaged with the recesses 314.

With reference to FIGS. 2, 4 and 5, the positioning blocks 40 are mounted on the positioning devices 30. Each positioning block 40 has two fixing recesses 41 and multiple tool recesses 42. The fixing recesses 41 are formed in a side of the positioning block 40. The two fixing recesses 41 of one of the positioning blocks 40 are respectively engaged with the inserting portions 321 of two of the positioning devices 30. The two fixing recesses 41 of the other positioning block 40 are respectively engaged with the inserting portions 321 of the other two of the positioning devices 30. The tool recesses 42 are formed in a side of the positioning block 40 at a position opposite to the fixing recesses 41. The tool recesses 42 can be used for holding different tool heads.

The connecting unit 50 is connected between the bodies 10, such that the bodies 10 are connected with each other by the connecting unit 50. The buckle unit 60 is mounted on sides of the bodies 10 at a position opposite to the connecting unit 50. The buckle unit 60 is detachably engaged with the bodies 10.

Figure 6:
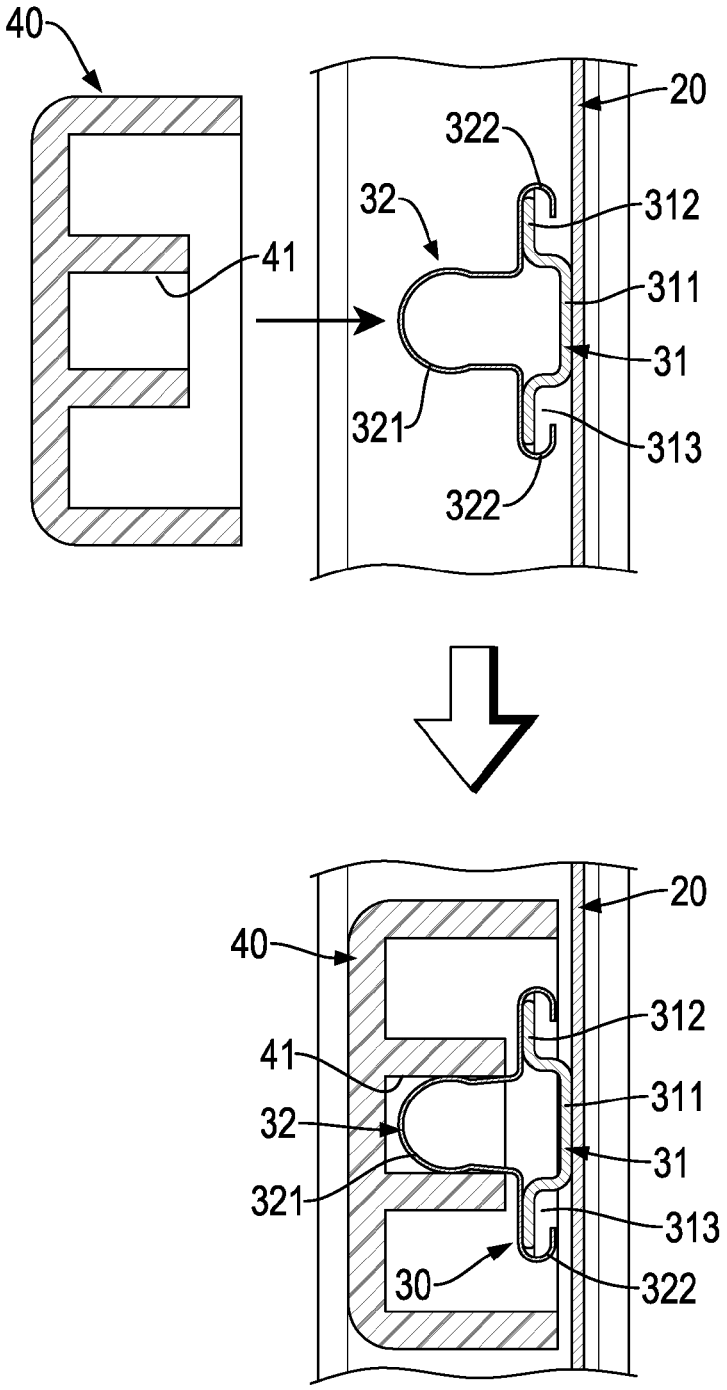
FIG. 6 shows enlarged operational side views of the tool box in FIG. 1.

With reference to FIGS. 3 and 6, in assembling, the inner boxes 20 are respectively mounted in the bodies 10 and are engaged with the engaging portions 14 to be fixed in the bodies 10. The fixing elastic plate 32 is hooked on the hooking portions 312 of the combining portion 311 by the hooking portions 322. Then the fixing elastic plate 32 is slid along the hooking portions 312. When the hooking portions 322 are slid into the recesses 314, the hooking portions 322 will be engaged with the recesses 314, such that the fixing elastic plate 32 can be mounted on the fixing base 31. Then, the fixing recesses 41 of the positioning block 40 are aligned with the inserting portions 321 of the fixing elastic plate 32, and then the positioning block 40 is pressed. Therefore, the inserting portions 321 can be inserted into the fixing recesses 41, and the positioning block 40 can be mounted on the positioning device 30.

For replacement, the original positioning block 40 is first pulled to detach from the positioning device 30. Then, a new positioning block 40 is mounted on the positioning device 30 according to the afore-motioned processes. Therefore, it is convenient for a user to replace different positioning blocks 40.

From the above description, it is noted that the present invention has the following advantages:

1. The positioning block 40 is mounted on the positioning device 30 by the fixing recesses 41 and the inserting portion 321, such that the positioning block 40 can be detached from the positioning device 30 easily. For replacement, the original positioning block 40 is pulled from the positioning device 30, and then a new positioning block 40 is mounted. The replacing process is easy for the user.

2. The engaging portions 14 can fix the inner boxes 20 in the bodies 10. The collision-resistant spaces 13 are provided as a buffer space, such that the bodies 10 are not broken easily upon a collision.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool box having:

two bodies connected with each other, and each body having a side wall being annular; and a body space formed in the body and having an opening located at a side of the body;

two inner boxes respectively mounted in the body spaces;

at least one positioning device mounted on an inner side of one of the inner boxes, and each positioning device having a fixing base mounted on the inner side of said one of the inner boxes and having a combining portion attached to the inner box;

two hooking portions respectively connected with two ends of the combining portion and being opposite to each other; and two recesses respectively formed in two ends of the hooking portions;

a fixing elastic plate detachably mounted on the fixing base and having an inserting portion being curved; and two hooking portions being hooked, respectively connected with two ends of the inserting portion, and respectively engaged with the recesses;

at least one positioning block mounted on the at least one positioning device, and each one of the at least one positioning block having at least one fixing recess formed in a side of the at least one positioning block and engaged with the inserting portion of the least one positioning device; and multiple tool recesses formed in a side of the positioning block at a position opposite to the at least one fixing recess; and a buckle unit mounted on the bodies.

2. The tool box as claimed in claim 1, wherein the hooking portions of the at least one positioning device are bent, and each fixing base further has two hook spaces respectively formed between the hooking portions of the fixing base and the inner box.

3. The tool box as claimed in claim 2, wherein each body further has multiple engaging portions formed on an inner side of the body and engaged with a corresponding inner box.

4. The tool box as claimed in claim 1, wherein each body further has a collision-resistant space formed in a part of the side wall.

5. The tool box as claimed in claim 2, wherein each body further has a collision-resistant space formed in a part of the side wall.

6. The tool box as claimed in claim 3, wherein each body further has a collision-resistant space formed in a part of the side wall.

* * * * *